US006415528B2

(12) United States Patent
Höller et al.

(10) Patent No.: US 6,415,528 B2
(45) Date of Patent: Jul. 9, 2002

(54) DRYING DEVICE FOR DRYING BULK MATERIAL

(75) Inventors: Klaus Höller; Holger Kühnau, both of Konstanz; Frank Fischer, Radolfzell; Carl Litherland, Konstanz, all of (DE)

(73) Assignee: Motan Holding GmbH, Konstanz (DE)

( * ) Notice: Subject to any disclaimer, the term of this patent is extended or adjusted under 35 U.S.C. 154(b) by 0 days.

(21) Appl. No.: 09/881,546

(22) Filed: Jun. 14, 2001

(30) Foreign Application Priority Data

Jun. 14, 2000 (DE) ..... 100 28 590

(51) Int. Cl.[7] ..... F26B 19/00

(52) U.S. Cl. ..... 34/548; 34/363; 34/477; 34/524; 34/558; 34/578; 165/104.16

(58) Field of Search ..... 34/79, 80, 165, 34/167, 168, 169, 209, 210, 212, 215, 218, 524, 548, 558, 86, 428, 513, 363, 578, 582, 586, 477; 165/104.16

(56) References Cited

U.S. PATENT DOCUMENTS 4,037,330 A * 7/1977 Kemmietmuller ..... 34/428
4,570,360 A * 2/1986 Nakagomi ..... 34/80
4,760,650 A * 8/1988 Theliander et al. ..... 34/513
5,555,636 A * 9/1996 Kramer ..... 34/86
5,896,675 A * 4/1999 Holler ..... 34/548

* cited by examiner

*Primary Examiner*—Ira S. Lazarus
*Assistant Examiner*—Kathryn S. O'Malley
(74) *Attorney, Agent, or Firm*—Gudrun E. Huckett

(57) ABSTRACT

A drying device for drying bulk material has one or more storage containers for the bulk material and a heating device for heating the drying air for drying the bulk material. A drying air conduit is connected to the heating device and the storage containers and guides the drying air to the storage containers. One or more first mixing valves are arranged in the drying air conduit upstream of the storage containers, wherein the first mixing valves are used to adjust the temperature of the drying air before the drying air enters the storage containers. The heating device has also the function of regenerating the drying units provided for removing the moisture from the drying air.

15 Claims, 3 Drawing Sheets

DRYING DEVICE FOR DRYING BULK MATERIAL

BACKGROUND OF THE INVENTION

1. Field of the Invention

The invention relates to a drying device for drying bulk material. The drying device comprises at least one storage container for the bulk material and a heating device with which the drying air for drying the bulk material is heated, wherein the drying air flows in a drying air conduit to the storage container.

2. Description of the Related Art

It is known to dry any type of bulk material in a storage container. For this purpose, a heated medium, preferably air, with a minimal water contents is guided through the bulk material in order to take up the moisture of the bulk material and to guide it via a conduit system out of the storage container to a dehumidification system. In this dehumidification system, the moisture is removed from the drying medium. The dehumidification is carried out by means of drying air dryers or other suitable dehumidification devices.

It is also known in the drying technology to preheat air for drying bulk material by means of heating devices and to supply the drying air via insulated conduits to the storage containers. When the drying devices have several storage containers, each storage container has correlated therewith a heating device in order to bring the supplied preheated air to the required temperature before the air enters the respective storage container.

As soon as the drying air dryer (drying unit) is saturated with moisture, it is regenerated. For this purpose, at least one additional heating device is provided with which regenerating air is heated to correspondingly high temperatures in order to remove the moisture from the drying medium.

These drying devices are of a complex construction and operate with a great energy expenditure.

SUMMARY OF THE INVENTION

It is an object of the present invention to configure the drying device of the aforementioned kind such that it can be operated with minimal energy expenditure while having a constructively simple configuration.

In accordance with the present invention, this is achieved in that a mixing valve is provided upstream of the storage container in the drying air conduit with which the temperature of the drying air can be adjusted before the drying air enters the storage container. This is furthermore achieved according to another embodiment in that a single heating device is used for heating the drying air and for regenerating the at least one drying medium unit.

The drying device according to the invention has only a single heating device for supplying one or more storage containers with heated drying air. By means of the mixing valve, the temperature of the drying air can be adjusted to the desired drying temperature before the drying air enters the storage container. As a result of the configuration according to the invention, the heating device can also be economically employed for small drying devices with many storage containers based on the selection of the energy carrier, for example, gas. The heating device is sized for the total output of the drying device and can thus be realized in a cost-efficient way. Accordingly, the use of expensive electricity for operating the heating device is no longer needed.

According to the above mentioned further embodiment, only a single heating device is used for the drying air as well as for the regenerating process of the drying medium unit, and the single heating device can be operated with a cost-efficient energy carrier, for example, gas. The use of a single heating device in the drying device according to the invention thus makes it possible to employ an economical heating technology for small drying devices.

DESCRIPTION OF THE PREFERRED EMBODIMENTS

Figure 1:
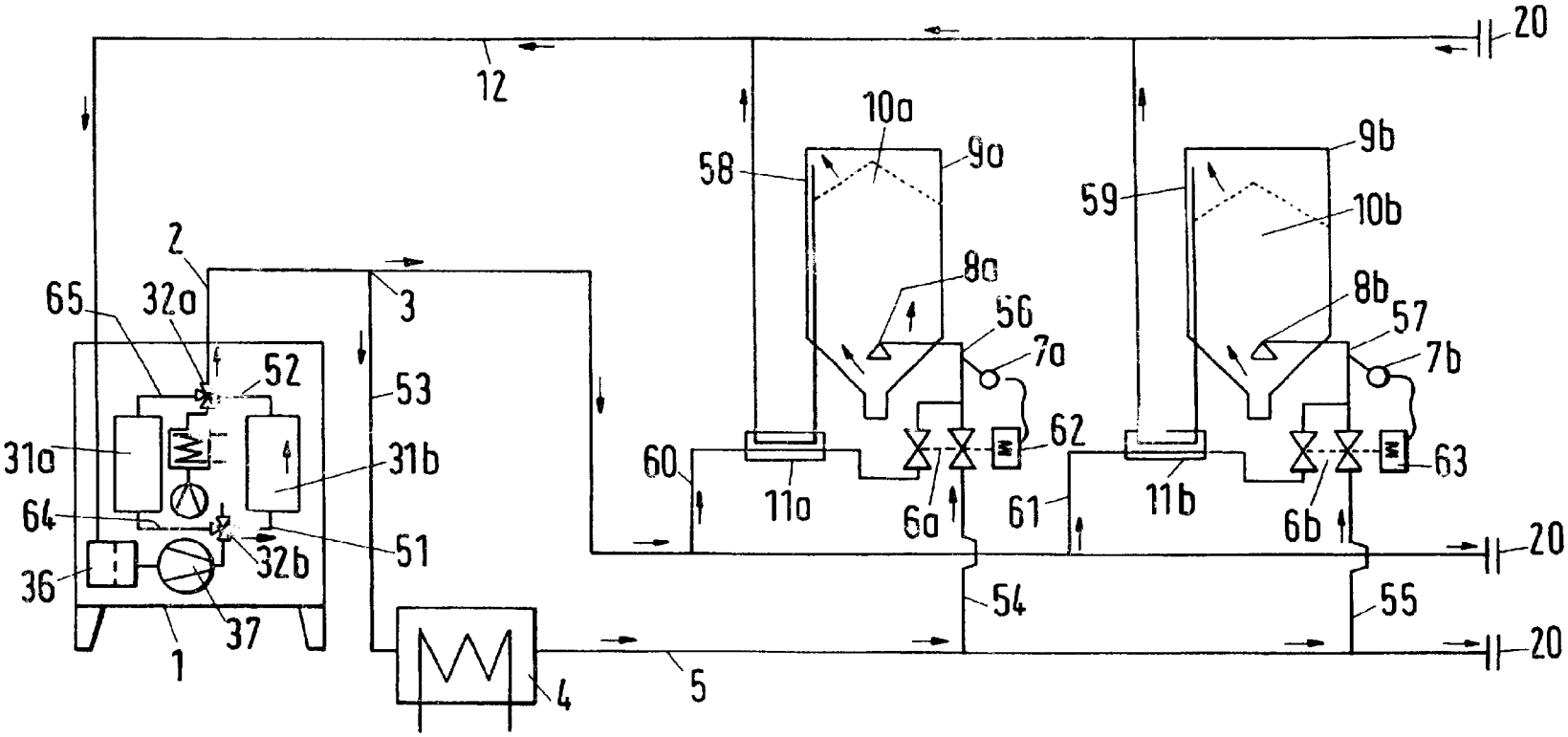
FIG. 1 shows a first embodiment of a drying device according to the invention.

With the drying devices according to the invention it is possible to employ only a single heating device for several storage containers containing material to be dried. In the embodiment according to FIG. 1, the drying device has, as an example, two storage containers 9*a*, 9*b*. A bulk material 10*a*, 10*b* that is to be dried is stored in these storage containers 9*a*, 9*b*. The drying device can also have only a single storage container or several storage containers for the bulk material to be dried. The drying air is guided through the bulk material 10*a*, 10*b*. The drying air is generated in at least one drying air generator 1. Depending on the size of the drying device, it is also possible to employ several drying air generators. The drying air generator 1 can be of any suitable configuration. It contains a blower 37 which has at the pressure side, downstream in the flow direction of the drying air, a valve 32*b* with which the process air, depending on the position of the valve 32*b*, is supplied to one of two drying medium cartridges (drying units) 31*a* or 31*b*. In the illustration according to FIG. 1, the valve 32*b* is switched such that the air is supplied via conduit 51 to the drying medium cartridge 31*b*. In the drying medium cartridge 31*b* moisture, which has been removed from the bulk material 10*a*, 10*b* by passing through the storage containers 9*a*, 9*b*, is removed from the process air.

After passing through the drying medium cartridge 31*b*, the process air flows via a conduit 52 to a valve 32*a* which is switched such that the dried process air reaches a drying air conduit 2. In the flow direction downstream of the drying air generator 1, a conduit 53 branches off the drying air conduit 2 at the branch junction 3. A portion of the drying air is guided via the conduit 53 to the heating device 4 in which it is heated. Downstream of the heating device 4, the drying air flows into a hot air conduit 5 from which conduits 54, 55 branch off which are connected to valves 6*a*, 6*b*. These valves 6*a*, 6*b* are configured as dual control valves. Via the valves 6*a*, 6*b* the drying air reaches conduits 56, 57 which project into the lower area of the storage containers 9*a*, 9*b*. Inside the storage containers 9*a*, 9*b*, the drying air exits through the outlets 8*a*, 8*b* centrally in the downward direction in a manner known in the art. It flows through the material 10*a*, 10*b* to be dried and exits at the upper area of the storage device 9*a*, 9*b* by entering a return air conduit 58, 59. The return air conduit 58, 59 of each storage container 9*a*, 9*b* is guided through a heat exchanger 11*a*, 11*b* in which the heated return air charged with moisture transfers its heat energy to the drying air flowing into the storage containers 9*a*, 9*b*. The return air conduits 58, 59 are connected to a return conduit 12 in which the return air is returned to the drying air generator 1. The return conduit 12 is connected inside the drying air generator 1 to a filter 36 which is positioned upstream of the blower 37 at its intake side.

Conduits 60, 61 are connected to the drying air conduit 2 in the flow direction of the drying air downstream of the branch junction 3. The conduits 60, 61 are guided through the respective heat exchanger 11*a*, 11*b* and are connected to the valves 6*a*, 6*b*.

The drying air conduit 2, the hot air conduit 5 as well as the return conduit 12 are closed off at the location 20. This closing location 20 is positioned behind the respective last storage container.

The drying air flow generated in the drying air generator 1 is guided via the drying air conduit 2 to the storage containers 9*a*, 9*b*. At the branch junction 3 a portion of the drying air flows into the conduit 53, while the other portion continues to flow through the drying air conduit 2. The portion of the drying air flowing through the conduit 53 is heated in the heating device 4 and flows via the hot air conduit 5 and the branch conduits 54, 55 in the direction toward the storage containers 9*a*, 9*b*. The hot air conduit 5 is advantageously insulated so that only minimal heat losses will occur. The portion of the drying air flowing through the drying air conduit 2 flows via the conduits 60, 61 and the heat exchangers 11*a*, 11*b* also to the valves 6*a*, 6*b*. In the heat exchangers 11*a*, 11*b* the return air flowing through the conduits 58, 59 transfers the heat it has taken up onto the drying air which flows through the heat exchangers 11*a*, 11*b*. Accordingly, the exhaust heat of the storage containers 9*a*, 9*b* can be optimally used and made available to the cold drying air.

The valves 6*a*, 6*b* are dual control valves with servomotors. With these valves, the mixing ratio between the drying air flowing through the conduits 60, 61 and the drying air, heated by passing through the heating device 5 and the conduits 54, 55, can be adjusted continuously. The two dual control valves 6*a*, 6*b* are thus configured as mixing devices with which the two drying air flows can be mixed in the desired ratio before they enter the storage container 9*a*, 9*b*. The two dual control valves 6*a*, 6*b* are embodied as 2/2 directional control valves which are working in opposite directions relative to one another on an actuator.

The valves 6*a*, 6*b* can be switched, for example, in such a way that the conduits 60, 61 are completely open. In this case, the conduits 54, 55 are closed so that exclusively the cold drying air, flowing through the drying air conduit 2 and the heat exchangers 11*a*, 11*b*, enters the storage container 9*a*, 9*b* via the conduits 56, 57.

The valves 6*a*, 6*b* can be switched such that the conduits 60, 61 are closed and the conduits 54, 55 are open. In this situation, only drying air flowing through and heated by the heating device 4 will enter the storage containers 9*a*, 9*b*.

When the conduits 60, 61 as well as 54, 55 are each half open, cold as well as heated drying air will flow via the valves 6*a*, 6*b* into the conduits 56, 57. Based on the respectively realized ratios of cold air and hot air, a mixed temperature thus results at the air entrance into the storage containers 9*a*, 9*b*. The valves 6*a*, 6*b* are advantageously controlled independently from one another so that at each storage container 9*a*, 9*b* different drying temperatures can be adjusted. Accordingly, an optimal adaptation to the respective temperature range and/or moisture degree of the bulk material 10*a*, 10*b* present in the respective storage containers 9*a*, 9*b* is possible.

A temperature sensor 7*a*, 7*b* is connected to the conduits 56, 57, respectively, which measures the temperature of the air flowing through the conduits 56, 57 and which sends a corresponding signal to the actuator 62, 63 of the valve 6*a*, 6*b*, respectively. The temperature sensors 7*a*, 7*b* are part of a control circuit with which the two mixing valves 6*a*, 6*b* can be controlled in order to achieve the desired setpoint values which are between the temperature of the cold drying air flowing through the conduits 60, 61 and the hot drying air flowing through the conduits 54, 55. The temperature sensors 7*a*, 7*b* measure the actual temperature of the drying air flowing within the storage container 9*a*, 9*b*. This actual temperature is compared to the setpoint temperature. When deviations occur, a control signal is generated in a manner known in the art which controls the valves 6*a*, 6*b* such that the cold drying air and the hot drying air will flow in the conduits 56, 57 with the required mixing ratio for achieving the desired setpoint temperature. In this case, the drying air has the desired drying temperature at the outlets 8*a*, 8*b* of the conduits 56, 57 in the storage container 9*a*, 9*b* which is the desired temperature for drying the respective bulk material 10*a*, 10*b*.

When the drying air passes through the bulk material 10*a*,10*b*, the drying air takes up the moisture of the bulk material. The drying air now charged with moisture flows via the return air conduits 58, 59 as return air into the return conduit 12. In the heat exchangers 11*a*, 11*b*, the described heat exchange with the cold drying air flowing in conduits 60, 61 takes place. The return air flows within the return conduit 12 through the filter 36 and the valve 32*b* into the drying medium cartridge 31*b*. The moisture of the drying air is removed by the drying unit (drying medium cartridge) 31*b* and the dried drying air can then flow via the correspondingly switched valve 32*a* back into the drying air conduit 2. In this way, the drying air is circulated within a drying air circuit.

Should the drying medium cartridge 31*b* be charged with moisture to such an extent that a sufficient drying is no longer possible, the two valves 32*a*, 32*b* are switched such that the return air can be guided via the conduit 64 into the drying medium cartridge 31*a*. From here, the dried drying air flows via conduit 65 and the valve 32*a* back into the drying air conduit 2.

The drying medium cartridge 31*b* now removed from the drying air circuit can be dried in a manner known in the art. The regenerating process will be explained in more detail with the aid of the embodiment illustrated in FIG. 3. For the different storage containers 9*a*, 9*b*, only a single heating device 4 is provided with which the drying of the bulk material 10*a*, 10*b* can be economically performed. The heating device 4 is sized for the total output of the drying device and can be realized in an inexpensive way. By using the dual control valves 6*a*, 6*b*, a suitable desired drying temperature can be adjusted in each storage container 9*a*, 9*b*.

Figure 2:
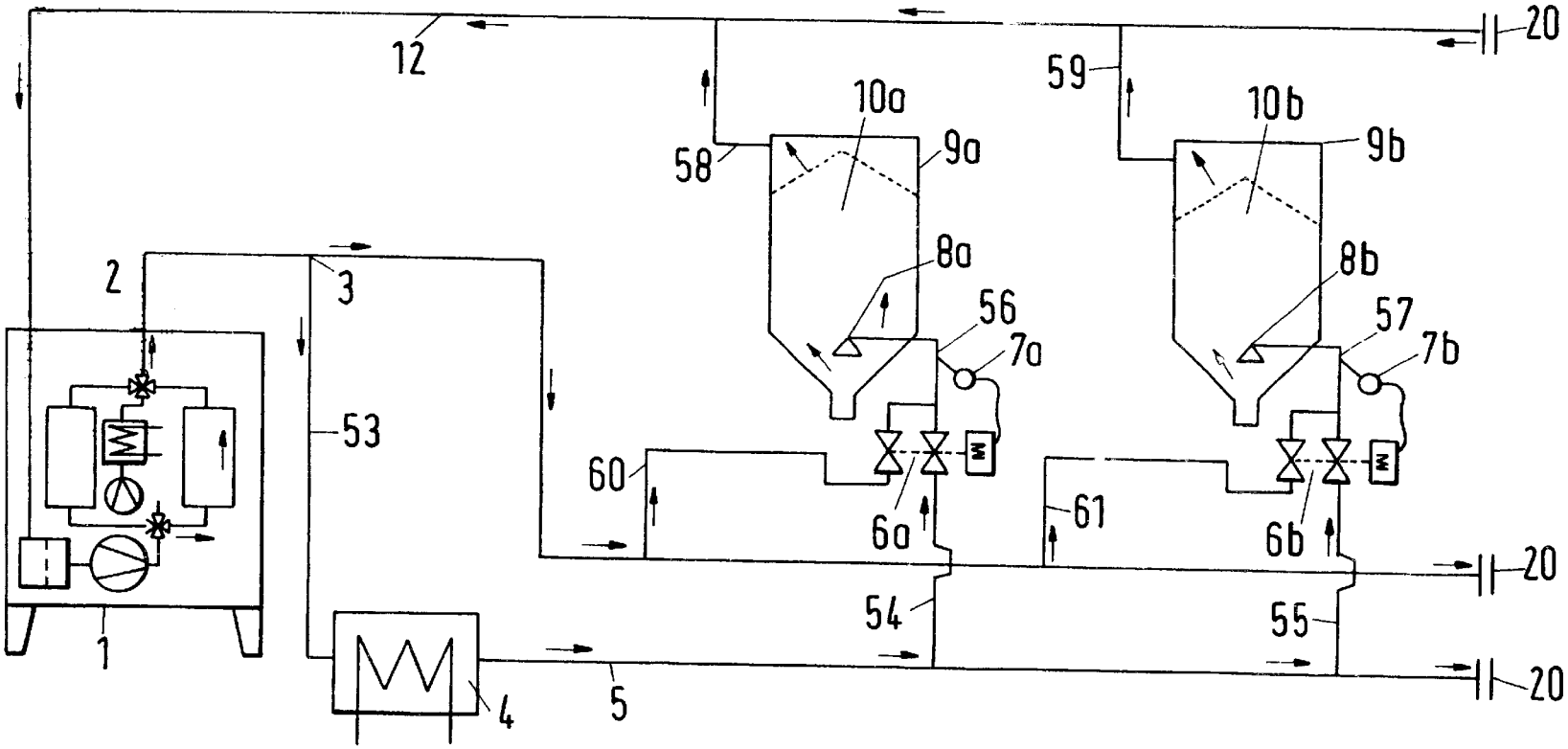
FIG. 2 shows in a representation corresponding to FIG. 1 a second embodiment of a drying device according to the invention.

The embodiment according to FIG. 2 differs from the previous embodiment in that the cold drying air is not guided through heat exchangers upstream of the valves 6*a*, 6*b*. The drying air dried in the drying air generator 1 flows in the described way into the drying air conduit 2. The cold drying air flowing through the conduits 60, 61 reaches the valves 6*a*, 6*b*. At the branch junction 3 in the drying air conduit 2 a portion of the drying air flows via the conduit 53 to the heating device 4 in which the drying air is heated. Subsequently, the heated drying air reaches the hot air conduit 5 from where it flows via conduits 54, 55 to the valves 6*a*, 6*b*. Depending on the position of the valves 6*a*, 6*b*, only the cold drying air or only the hot drying air or a mixture of the two reaches the conduits 56, 57, as has been explained with the aid of the previous embodiment. After flowing through the bulk material 10*a*, 10*b* in the storage containers 9*a*, 9*b*, the return air charged with moisture exits at the upper end of the storage container 9*a*, 9*b* and enters the return air conduits 58, 59. The return air charged with moisture flows in these conduits to the return conduit 12 and from here to the drying air generator 1. Here, the return air is dried in the way described in connection with FIG. 1 and is returned into the drying air conduit 2.

In other respects, the embodiment according to FIG. 2 is identical to the embodiment according to FIG. 1.

Figure 3:
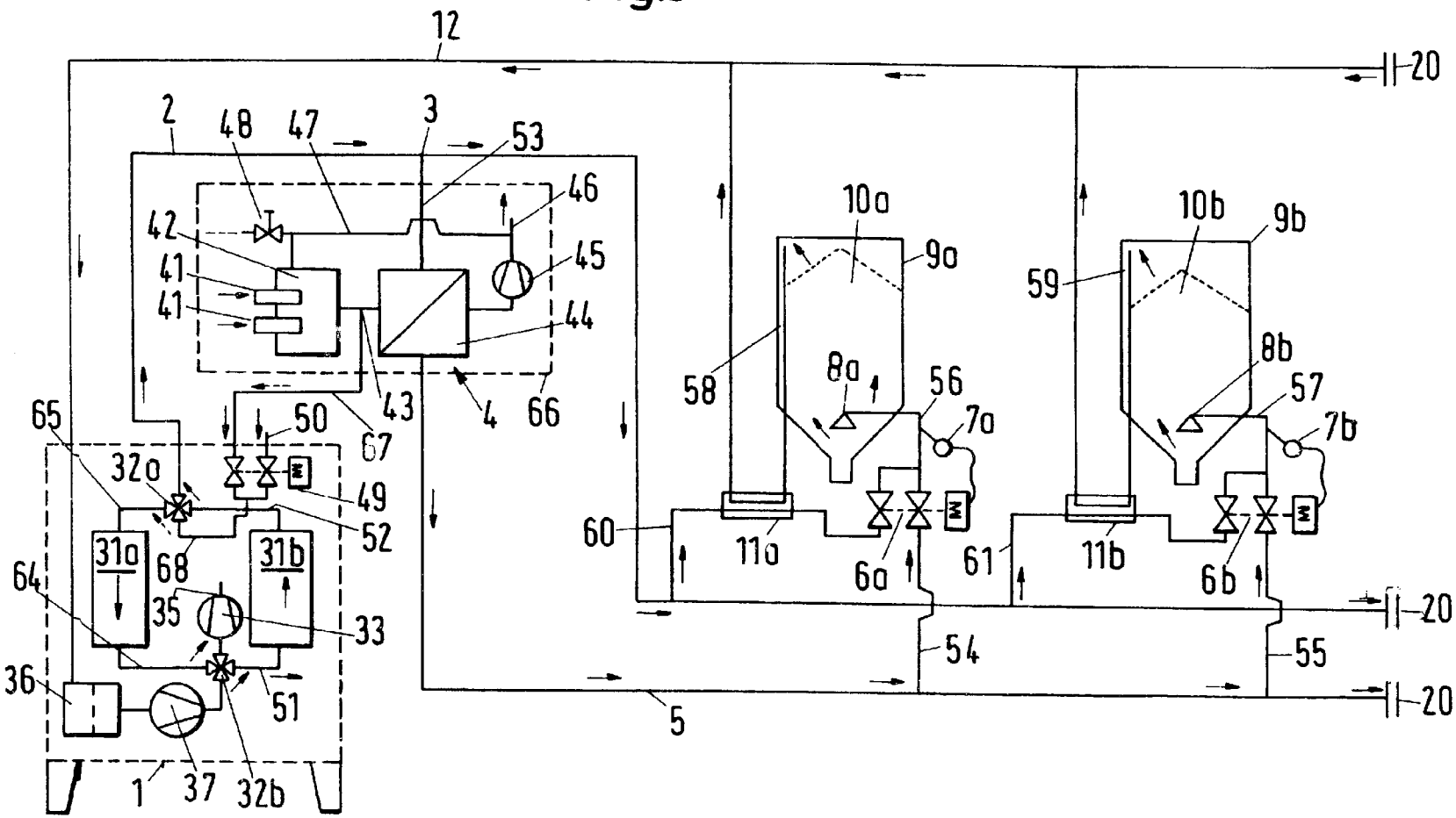
FIG. 3 is a representation corresponding to FIG. 1 of a third embodiment of a drying device according to the invention.

FIG. 3 shows a drying device configured such that the desired setpoint temperature of the drying air entering the respective storage containers 9*a*, 9*b* is adjusted in the described way and, at the same time, the drying medium cartridges 31*a*, 31*b* in the drying air generator 1 are regenerated by means of the only heating device 4. In the process control of continuously operating drying devices, at least one drying medium cartridge is used at all times for dehumidification of the bulk material while at least one further drying medium cartridge is subjected to regeneration or dehumidification. In order to ensure continuity of the process, at all times at least two drying medium cartridges are therefore operated alternatingly. For example, in order to regenerate or to dehumidify the drying medium cartridge 31*a*, it is heated. In conventional drying devices, this heating is carried out conventionally by means of additional heating devices which are installed within the drying air generator. In small drying systems the energy carrier is often electricity which is expensive and uneconomical.

In the drying device illustrated in FIG. 3, the heating device 4 is used in connection with a cost-beneficial energy carrier. Since in accordance with the two previous embodiments only a single heating device 4 is provided in the drying device, an economical heating technology can be used also for small drying devices.

The single heating device 4 is advantageously gas-heated and serves for heating the drying air before the drying air enters the storage containers 9*a*, 9*b* as well as for regenerating the drying medium cartridges (drying units) 31*a*, 31*b* when they are saturated with moisture.

The heating device 4 has a housing 66 in which an air circulation is arranged in which the air is conveyed by a blower 45. The blower 45 is connected at its intake side with a heat exchanger 44 which is connected by the pipeline 43 to a burner unit comprised of a combustion chamber 42 and burners 41. With this arrangement, in the combustion chamber 42 a vacuum is present which makes it possible that a gas to be combusted is sucked into the burner 41 and is combusted therein. In the combustion chamber 42, which is arranged in the housing 66 of the heating device 4 together with the heat exchanger 44 and the blower 45, a temperature of preferably above 200° C. is generated in order to be able to optimally regenerate the respective drying medium cartridges 31*a*, 31*b* in the drying air generator 1. The temperature in the combustion chamber 42 however can also have, as needed, a different value which is expedient for regeneration of the drying medium in the drying medium cartridges 31*a*, 31*b*.

The heat exchanger 44 serves for heating the cold drying air which flows via the drying air conduit 2 and the hot air conduit 5 to the storage containers 9*a*, 9*b*. In the heat exchanger 44 the drying air is heated to such a high temperature that the bulk material 10*a*, 10*b* in the storage containers 9*a*, 9*b* is dried optimally in any situation.

Since in the flow direction downstream of the heat exchanger 44 the air temperature is still relatively high, a return conduit 47 is connected to the pressure side of the blower 45. A gas conduit 46 provided at the pressure side of the blower 45 releases the amount of exhaust air which is taken up into the circulation by the burners 41.

In FIG. 3 the situation is illustrated where the drying medium cartridge 31*a* is heated and thus dehumidified. For the regeneration process a valve 48 provided in the housing 66 of the heating device 4 is opened in order to guide additional exterior air into the combustion chamber 42 which is taken out of the circulation. Simultaneously with the switching of the valve 48, the dual control valve (mixing valve) 49 is switched. As long as a regeneration process does not occur, this dual control valve 49 is switched such that pure exterior air is supplied via exterior air conduit 50. In this position of the valve 49, a branch conduit 67 which extends from the pipeline 43 to the valve 49 is closed. By switching the valve 49, the conduit 67 is additionally opened so that in addition to the exterior air conduit 50 also heating air is sucked in from the pipeline 43 via the conduit 67. The dual control valve 49 which is advantageously provided in the drying air generator 1 corresponds in its configuration to the dual control valves 6*a*, 6*b*. By means of the mixing valve 49, the right temperature required for regeneration of the drying medium cartridge 31*a* can be adjusted in a simple way.

The dual control valve 49 is connected by a conduit 68 with the valve 32*a*.

The valves 32*a*, 32*b* are adjusted such that the regenerating air flows through the drying medium cartridge 31*a* (dashed arrows). The regenerating air, whose temperature depends on the position of the dual control valve 49, flows via the conduit 68, the valve 32*a*, and the conduit 65 into the drying medium cartridge 31*a*. The drying medium contained therein is heated by the regenerating air and is thus dried. Via the conduit 64 the regenerating air exiting from the drying medium cartridge 31*a* reaches the valve 32*b*. A blower 33 is arranged downstream of the valve 32*b* in the flow direction of the regenerating air. It sucks in the regenerating air from the conduit 64 and delivers it at the location 35 as exhaust air to the exterior. The switching of the valves 32*a*, 32*b*, 48, 49 is maintained until the drying medium cartridge 31*a* is dehumidified.

In order to be able to switch the drying medium cartridge 31*a* after removal of moisture as quickly as possible back to the drying circuit, it is cooled down to operating temperature directly after dehumidification. For this purpose, the valve 48 is again closed and the dual control valve 49 switched such that the conduit 67 is closed and only the cool exterior air 50 is taken in by the blower 33. The cool exterior air 50 flows via the valve 49, the conduit 68, the valve 32*a*, and the conduit 65 into the drying medium cartridge 31*a*. When passing through the drying medium cartridge 31*a*, the exterior air 50 cools the drying medium. Via the conduit 64 and the valve 32*b* the cool exterior air 50 reaches the location 35 and is released to the exterior. This cooling is carried out until the drying medium in the drying medium cartridge 31*a* has reached the operating temperature.

By switching the valves 32*a*, 32*b*, the regenerated drying medium cartridge 31*a* can be switched back into the drying circuit while the drying medium cartridge 31*b* is now regenerated in the manner described above.

The cooling of the regenerated drying medium cartridge 31*a*, 31*b* can, of course, also be carried out in a different way, as is known in the prior art. In particular, the cooling can be carried out in a closed circuit with a cooling device.

The drying circuit corresponds basically to the embodiment according to FIG. 1. The return air, coming from the return conduit 12 and being charged with moisture, flows via the blower 37, the valve 32*b*, and the conduit 51 into the drying medium cartridge 31*b* in which the moisture is removed from the drying air. Via the conduit 52 and the valve 32*a* the dried drying air is guided into the drying air conduit 2. A portion of the drying air bypasses the heating device 4 and flows to the conduits 60, 61 via which this cool drying air flows via the heat exchangers 11*a*, 11*b* to the valves 6*a*, 6*b*. At the branch junction 3 of the drying air conduit 2 a portion of the drying air flows into the conduit 53 in which it is guided via the heat exchanger 44, where this portion of the drying air is heated, and flows via the hot air conduit 5 and the conduits 54, 55 to the valves 6*a*, 6*b*. Depending on the switching position of the valves 6*a*, 6*b*, only the cold drying air or only the hot drying air or a mixture of the two is supplied to the storage containers 9*a*, 9*b*. At the outlet 8*a*, 8*b* of the conduits 56, 57, the drying air flows initially downwardly into the bulk material 10*a*, 10*b*. After passing through the bulk material, the drying air, now charged with moisture, reaches the return air conduits 58, 59. When passing through the heat exchangers 11*a*, 11*b*, the waste heat is used for heating the drying air flowing through the conduits 60, 61. Subsequently, the return air reaches the return conduit 12 in which it is guided back to the drying air generator 1.

According to the embodiment of FIG. 2, the heat exchangers 11*a*, 11*b* can be omitted in the drying device according to FIG. 3.

For the entire drying device according to FIG. 3 only a single heating device 4 is provided. It not only provides the heat for drying the bulk material 10*a*, 10*b*, but also the heat energy required for regeneration of the drying medium in the drying medium cartridges 31*a*, 31*b*. The heating device can be operated with a cost-efficient energy carrier, such as, for example, gas, so that the heating device is economical also for small systems or systems with many storage containers 9*a*, 9*b*. In all embodiments, the heating device 4 is sized according to the total output of the drying device so that it can be realized in a cost-efficient way. Accordingly, the use of expensive electricity can be eliminated for operation of the heating device 4.

While specific embodiments of the invention have been shown and described in detail to illustrate the inventive principles, it will be understood that the invention may be embodied otherwise without departing from such principles.

What is claimed is:

1. A drying device for drying bulk material, said drying device comprising:

one or more storage containers (9*a*, 9*b*) for the bulk material;

a heating device (4) configured to heat drying air for drying the bulk material;

a drying air conduit (2, 5, 54, 55, 60, 61) connected to said heating device (4) and said one or more storage containers (9*a*, 9*b*) and guiding the drying air to said one or more storage containers (9*a*, 9*b*);

one or more first mixing valves (6*a*, 6*b*) arranged in said drying air conduit (2, 5, 54, 55, 60, 61) upstream of said one or more storage containers (9*a*, 9*b*), wherein said one or more first mixing valves (6*a*, 6*b*) are configured to adjust a temperature of the drying air before the drying air enters said one or more storage containers (9*a*, 9*b*).

2. The drying device according to claim 1, wherein said drying air conduit (2, 5, 54, 55, 60, 61) comprises a first conduit branch (2, 60, 61) and a second conduit branch (53, 5, 54, 55), wherein said second conduit branch (53, 5, 54, 55) extends through said heating device (4).

3. The drying device according to claim 2, further comprising a heat exchanger (11*a*, 11*b*) arranged in said first conduit branch (2, 60, 61) upstream of said one or more first mixing valve (6*a*, 6*b*) in a flow direction of the drying air.

4. The drying device according to claim 3, further comprising a return air conduit (58, 59) connected to said one or more storage containers (9*a*, 9*b*) and guided through said heat exchanger (11*a*, 11*b*).

5. The drying device according to claim 1, wherein said heating device (4) is configured to heat the drying air for several of said one or more storage containers (9*a*, 9*b*).

6. The drying device according to claim 5, wherein each one of said one or more storage containers (9*a*, 9*b*) has one of said one or more first mixing valves (6*a*, 6*b*) correlated therewith.

7. The drying device according to claim 1, further comprising at least one drying medium unit (31*a*, 31*b*) configured to dry the drying air, wherein said heating device (4) is configured to regenerate said at least one drying unit (31*a*, 31*b*) in addition to heating the drying air.

8. The drying device according to claim 7, wherein said heating device (4) has at least one heat exchanger (44) configured to transfer heat from regenerating air, provided for regenerating said at least one drying medium unit (31*a*, 31*b*), to at least a portion of the drying air.

9. The drying device according to claim 8, wherein said heating device (4) comprises at least one burner unit (41, 42) arranged upstream of said at least one heat exchanger (44) in a flow direction of the drying air.

10. The drying device according to claim 9, further comprising a second mixing valve (49) arranged in a flow direction of the regenerating air upstream of said at least one drying medium unit (31*a*, 31*b*), wherein said second mixing valve (49) is configured to adjust a temperature of the regenerating air.

11. The drying device according to claim 10, further comprising an exterior air conduit (50), connected to said second mixing valve (49), and a heating conduit (67), connected to said second mixing valve (49).

12. The drying device according to claim 10, further comprising a blower (45) connected to said at least one heat exchanger (44).

13. The drying device according to claim 12, further comprising a return conduit (47) connected to a pressure side of said blower (45) and to said at least one burner unit (41, 42).

14. The drying device according to claim 10, wherein said first and second mixing valves (6*a*, 6*b*, 49) are configured to be controllable.

15. The drying device according to claim 1, wherein said heating device (4) is a gas heater.

* * * * *